United States Patent [19]

Pfeiffer et al.

[11] 4,445,354

[45] May 1, 1984

[54] PROCEDURE AND EQUIPMENT FOR THE MANUFACTURE OF PIPES WITH EXTERNAL AND INTERNAL DIAMETERS VARYING IN STAGES

[76] Inventors: Gerd Pfeiffer, IM Look 55, D-4330 Mulheim; Horst Stinnertz, Knickelsdorf 89, D-4156 Willich 3; Fritz Zeunert, Im Hag 2, D-4050 Monchengladbach 2, all of Fed. Rep. of Germany

[21] Appl. No.: 400,788

[22] Filed: Jul. 22, 1982

[30] Foreign Application Priority Data

Jul. 24, 1981 [DE] Fed. Rep. of Germany ..... 3129903

[51] Int. Cl.[3] ..... B21B 17/10

[52] U.S. Cl. ..... 72/208; 72/198; 72/214

[58] Field of Search ..... 70/208, 214, 198, 189, 70/366

[56] References Cited

FOREIGN PATENT DOCUMENTS 1413859 11/1975 United Kingdom ..... 72/214

*Primary Examiner*—Francis S. Husar
*Assistant Examiner*—Jorji M. Griffin
*Attorney, Agent, or Firm*—Daniel Patch; Suzanne Kikel

[57] ABSTRACT

The present invention relates to a cold pilger rolling mill and a method and means for manufacturing tubes with externally and/or internally thickened portions by reducing the tubes over a mandrel by means of grooved rolls which are mounted in a reciprocating roll stand. The invention provides several different varying diameter grooves on the rolls, which grooves can be brought into play one after the other by rotation of the rolls through an adjustment of the toothed racks on which the rolls are mounted. Consequently, at least one groove is provided for the rolling out of the required cross-section of most of the tube and a second groove is provided for the rolling of a thickened portion of the tube. It is essential that a smoothing zone is associated with each groove, and a zone for rotating and advancing the tube is associated with at least one of the grooves.

13 Claims, 6 Drawing Figures

Figure 1:
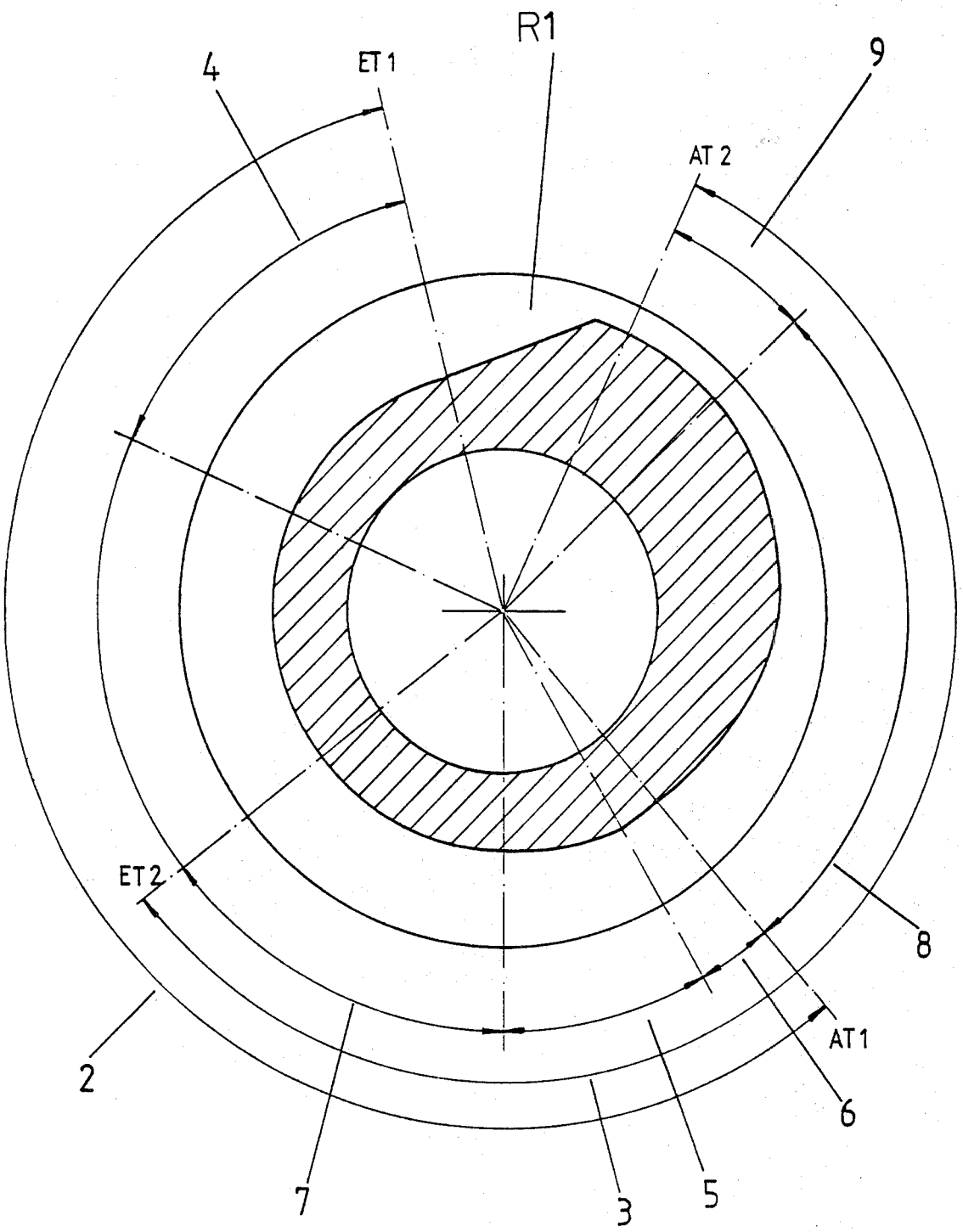

PROCEDURE AND EQUIPMENT FOR THE MANUFACTURE OF PIPES WITH EXTERNAL AND INTERNAL DIAMETERS VARYING IN STAGES

BACKGROUND OF THE INVENTION

The invention relates to a method and means for producing tubes or pipes with external and, if necessary, internal varying diameters in stages by reducing the tubes over a mandrel by means of grooved rolls having varying diameters, which rolls are mounted in a reciprocating roll stand of a cold pilger rolling mill of the types disclosed in U.S. Pat. Nos. 3,566,658 and 3,890,821.

Tubes or pipes with internally and/or externally thickened portions are required in many commercial and industrial areas. This is especially true for oil field pipes; particularly for drill pipes with thickened ends, which are either formed by hot-rolling or by welding a separate piece on the ends. The required hardness of these ends is achieved by tempering. The financial and technical expense for this process is very great.

It is, therefore, an object of this invention to provide a method and means for substantially reducing the expense involved for producing thickened ends of a pipe by employing a cold pilger rolling mill and the process thereof, wherein the thickened ends are a continuous portion and not disjunct pieces of the produced pipe.

It is well-known to employ in cold pilger mills as to the practice of varying the external diameter of pipes. Two such measures are known: namely, (1) the changing of the roll spacing during the rolling of a pipe; or (2) the changing of the effective length of reduction of a roll groove. The latter measure is achieved by one of two ways: either (a) by changing the effective crank radius so that for the fabrication of an external thickening on the delivery end a part of the length of the groove is not rolled or brought into working contact with the shell, or (b) by rotating the rolls by adjusting the toothed rack upon which the pinions at the ends of the roll shafts are in engagement, so that in this case as well, a part of the length of the groove is not rolled.

Both the above two known measures in the preceding paragraph inherently consists of several disadvantages to the extent they could not efficiently and effectively produce thickened pipe ends. The changing of the roll spacings during the rolling of the pipe requires an expensive mechanical construction of the stand. In both cases, the rolls only form one groove, and the groove width of the rolls coincides to that of the largest pipe diameter and is, consequently, too large for the smaller pipe diameter. This results in poor pipe surface quality and unfavorable deformation properties. This measure or procedure is furthermore unsuitable for the required differences in diameter for drill pipes.

The varying of the effective length of reduction of a roll groove is also disadvantageous. With regard to form (a) i.e. the varying of the effective crank radius, this requires an expensive mechanical construction. In addition to that, no smooth groove is near the vicinity of the thickening portion of the groove so that a poor pipe surface condition is to be expected. For greater differences in diameter, this procedure is unsuitable due to the required widths of the groove resulting in deformation and poor surface quality when the smaller diameter pipe is being rolled. Rotating the rolls by way of form (b) which is by means of adjusting the toothed racks for varying the effective length of reduction represents, indeed, a lesser mechanical expenditure, however, the same disadvantages otherwise occur as for the immediate previously described procedure.

A still further object of the present invention is to provide several grooves around the circumferences of a set of rolls in a pilger mill for fabricating different external diameters, whereby a smoothing zone is associated with each groove and a zone for rotating and/or, advancing the pipe is associated with at least one groove.

While all known cold pilger procedures for the fabrication of varying pipe diameters work solely with one groove, which comes into engagement wholly or partially in the case of external enlargement or thickenings, the invention provides several grooves on one ring roll set, whereby a groove is defined as a closed zone of deformation, which leads from a defined shell cross-section to a defined pipe cross-section.

According to a further object of the subject invention, two grooves are provided, of which a first groove is brought into engagement for the rolling of the large external diameter, and the first and at least a part of a second groove are brought into engagement one after the other for the rolling of the small external diameter of the pipe during a working travel of the stand. This procedure and the configuration of the grooves advantageously provides smoothing zones between the two varying grooves on the ring roll, whereby the quality of the pipe surface and the geometry of the transition zone from a larger to a smaller external diameter is far superior than that of those pipes produced by the previously known procedures.

Another object of the present invention is to provide three grooves, whereby the large external diameter is rolled by a first decreasing groove; subsequently, a first section of the small external diameter is rolled on with an increasing groove, and the small external diameter is rolled out with a further decreasing groove. With this procedure, the length of the transition zone from the large external diameter to the small external diameter can be considerably diminished or tapered while retaining the previously mentioned advantages. In addition, the rotating and advancing of the pipe can take place in the delivery dead center, so that deformation work can be done both during the forward pass or travel of the stand as well as during its backward pass or travel. It is also part of the present invention that the smoothing zone and/or the zone serving for the rotation and/or advancement of the pipe be used in common for two neighboring grooves. This will result in the obtaining of large groove lengths for a given roll diameter.

According to the teachings of the present invention wherein the ring pass roll has two grooves, the first groove runs in a constantly decreasing fashion, whereby the start of this groove is designed to coincide with the diameter of the shell, and the end of this groove is designed to coincide with the large external diameter of the pipe; and the start of the likewise constantly decreasing second groove is designed to coincide with the large external diameter and the end of this groove is designed to coincide with the small external diameter of the pipe, the large and small diameters being of predetermined desired dimensions. By means of this construction of the grooves, a given roll circumference can be used optimally, by virtue of the fact that both grooves can be implemented for the large reduction from the diameter of the shell to the desired final cross-section.

According to the teachings of the present invention the rolls with three grooves, permit the rolling of short transitional areas between the varying diameters, and is characterized by the fact that the ring pass roll is provided with a groove which increases in the direction of rolling, and two additional grooves which decrease in the direction of rolling, whereby the grooves have varying profiles. In this case, the groove which increases in the direction of rolling serves for the substantial rolling out of the pipe, while the grooves which decrease in the direction of rolling serve for the rolling of the thickening portions of the pipe.

According to a further object of the present invention, it is provided that the transition from the engagement of one groove to the next on the workpiece is done by displacing the toothed rack which drives the roll pinion. This measure, is well-known in the art and, in combination with the teachings of the subject invention provides a simple mechanical means to bring into operation the various grooves of the rolls, thereby eliminating or decreasing the costs involved for its installation and operation on already existing cold pilger mills. Furthermore, in the rolling process, it is proposed that for minimizing the shell and mandrel rod forces which occur, the toothed rack is to be constantly oscillated. Preferably, the amount of oscillation of the toothed rack will depend on the rolling program.

For the manufacture of pipes with internally thickened ends, it is proposed according to a particular aspect of the subject invention that the mandrel be provided with a range of varying diameters, which diameters can be made in the pipe by a longitudinal displacement of the mandrel in the zone of deformation of the ring rolls. The mandrel is, as is well-known in the art, divided into a zone for rolling the internal thickening and into another zone for rolling the actual cross-section of the pipe, whereby the various zones are brought into play according to the desired internal diameter. This procedure is well-known, and used in combination with the teachings of the present invention, offers the option of optimally manufacturing pipes having thickened internal diameters and/or external diameter which until the subject invention was only previously economically feasible by means of hot rolling.

Figure 2:
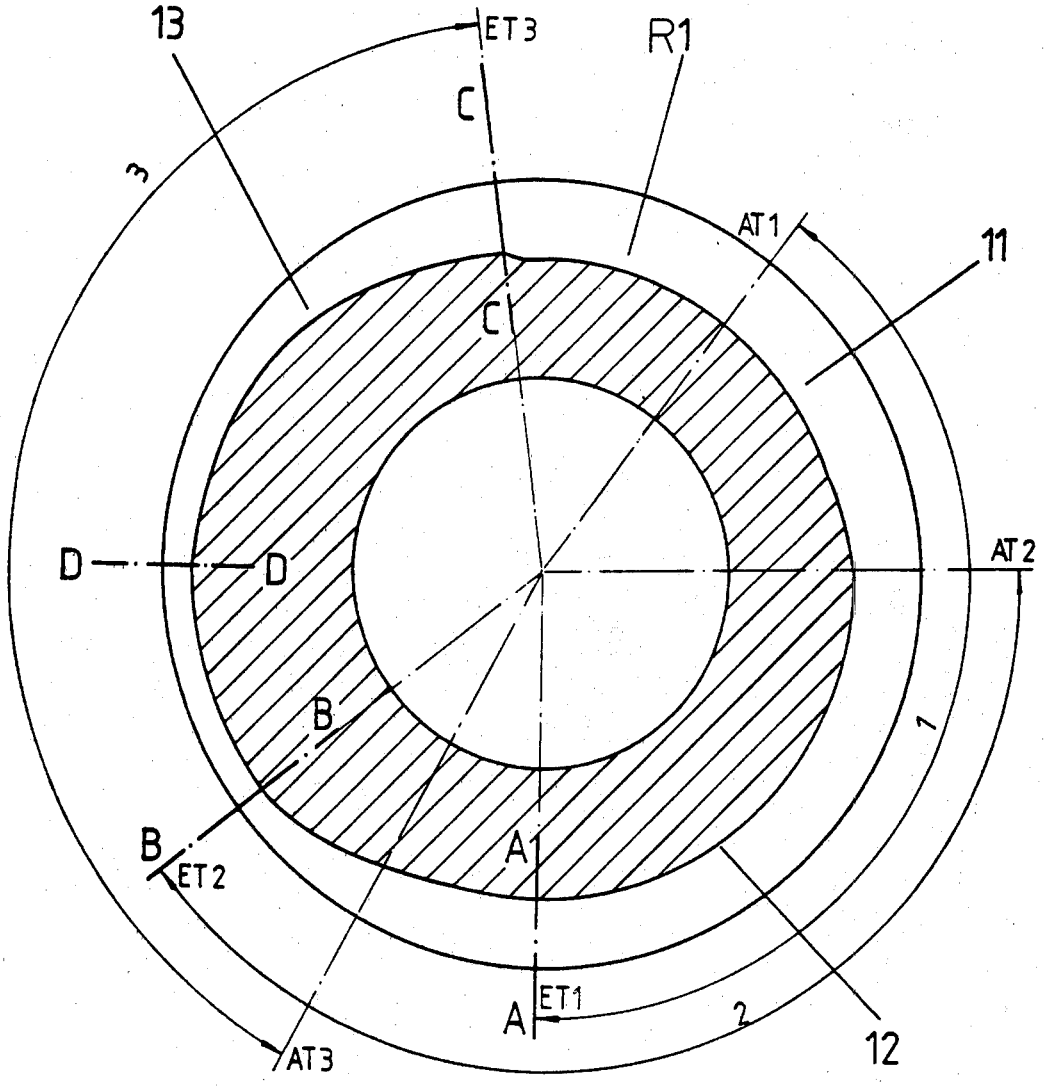

These objects as well as other novel features and advantages of the present invention will be better appreciated and understood when the following description is read along with the accompanying drawings of which:

FIG. 1 a cross-section through a ring roll having two grooves arranged circumferentially thereof;

FIG. 2 a cross-section through a ring roll having three grooves, arranged circumferentially thereof; and FIGS. 3 through 6 are sections showing the varying groove ranges of the roll of FIG. 2, taken along lines A—A through D—D thereof.

In FIG. 1, the ring roll 1 is a roll of a pair of rolls of a pilger mill and has two rolling ranges 2 and 3, and for the reduction process cooperates with the other roll of the set which is similarly constructed to produce a working area or groove as shown in the above mentioned U.S. patents particularly U.S. Pat. No. 3,890,821. In this instance, the first rolling or reducing range 2 which extends from ET1 to AT1 serves for the reduction of the shell to a thickening, and the second rolling range 3 which extends from ET2 to AT2 serves for the reduction of the shell from the thickening to the finished cross-section of the pipe. The first rolling range 2 from the run-in dead center ET1 to the run-out dead center AT1 comprises: a switching range 4 for the rotation and or advancement of the pipe in the range of the entry dead center ET1; an empty zone without contact between rolls and pipe; a first deformation or transformation zone 5 for the rolling of the thickening portion; and a first smoothing zone 6 for the smoothing of the thickening portion.

For the rolling of a desired or given diameter for the remainder of the pipe, roll 1 with its cooperative working roll is rotated preferably in an out-of-gear advance i.e. where the shell is not fed forward into the mill, but with the travel of the rolling mill, in such a manner that the second rolling range 3 is brought into engagement with the run-in and out dead centers ET2-AT2 respectively, in stages. The second rolling range 3 comprises: a second switching range 7; deforming and smoothing zones 5 and 6, respectively, for the rolling of the thickening portion; as well as a second deforming or transformation zone 8 for a further reduction of the thickening to a desired diameter for the pipe; and a second smoothing zone 9 for the smoothing of the pipe.

A working cycle or operation for the rolling of a pipe by a pair of rolls having a roll configuration as shown in FIG. 1 is as follows: First of all, the first rolling range 2 rolls upon or works the shell or stock. In the first switching range 4, the pipe is rotated and advanced, whereby the shell to be rolled is released from a mandrel (not shown). The stock is moved between the rolls in the area of the grooves which has a diameter somewhat larger than the shell wherein there is no work being done up to the beginning of the first deforming zone 5. The first deforming zone 5 now rolls the shell diameter to the diameter of the thickening for a required length. Subsequently, the rotation of roll 1 begins with the shell being fed forward into the mill whereby the second deforming zone 8 works upon the stock in stages. In connection with this, as a result of the stepwise increase in reduction, a cone-shaped transition zone of the already rolled thickening is generated for the pipe which is in the process of being formed. If in this case, the roll has already reached the second rolling range 3, the advance is put back into gear i.e. the shell is fed forward into the mill, if the need arises, and the actual cross-section of the pipe is rolled to its full length. This is done in two stages for every pass of the stand; namely, in the first deforming zone 5, the work-piece is rolled from a shell to thickening, and in the second deforming zone 8, from thickening to the given pipe. When the length of workpiece provided is almost rolled out, roll 1 can be rotated back once more to the first rolling range 2, where the trailing end can be rolled into a thickening, and thus the working cycle is completed. The rotation process of the roll is done in the traditional fashion by linearly displacing the toothed rack in the appropriate direction for the roll drive by suitable means known in the art, but not shown.

Figures 3, 4, 5, 6:
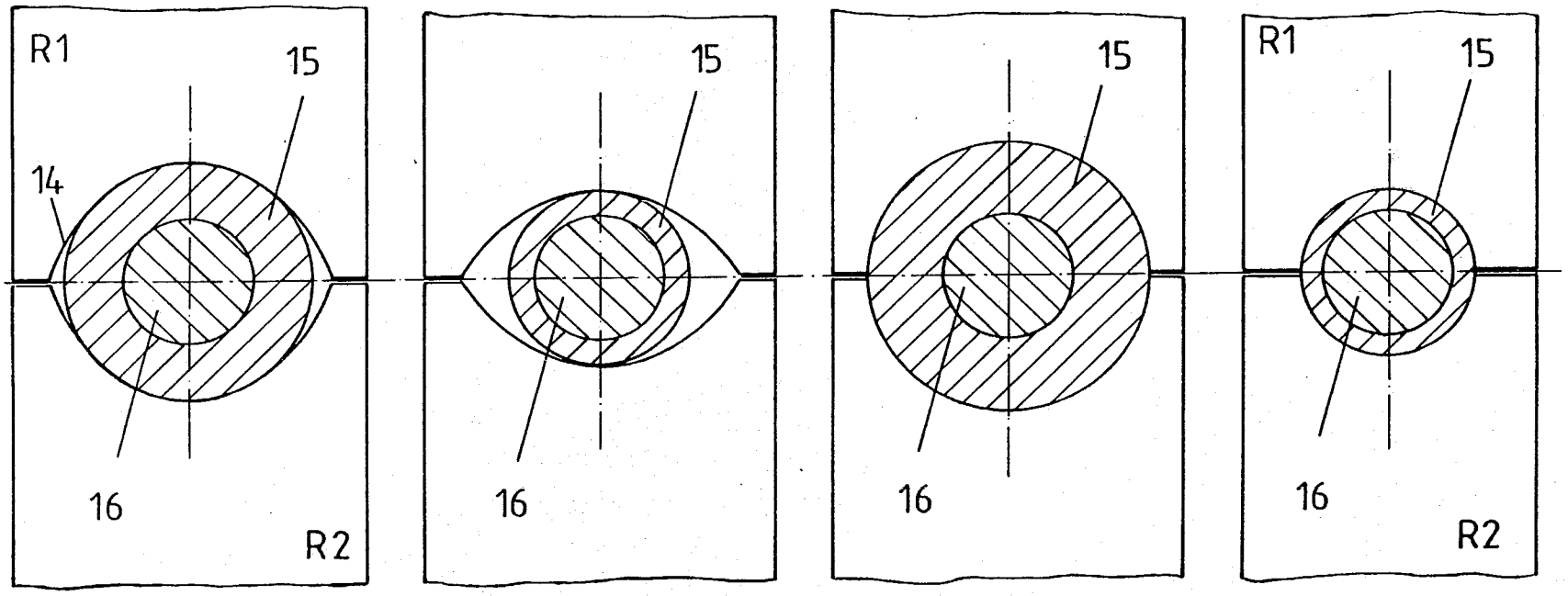

In FIG. 2, the ring roll is likewise designated with 1 and cooperates with a similarly constructed roll to form a working groove. In the case of this embodiment, the ring roll R1 is provided with three grooves 11, 12 and 13. Groove 11 serves for the rolling of the thickened portion of pipe, whereby the pass of the stand travels from the entry dead center ET1 to the delivery dead center AT1 which is rolling region 1. Because of the slight reduction in diameter of the wall of the pipe which occurs in this case, no considerable depth in the groove is required. Thus, groove 11 shows a course which does not narrow or taper, whereby the depth of the groove corresponds to the diameter of the thickened end of the pipe and the width of the groove corresponds to the diameter of the shell. The groove of the sectional plane taken along lines A—A is illustrated in FIG. 3. Here, the upper ring roll is designated as R1 and the lower ring roll as R2; while the groove is indicated by 14. The cross-section of the pipe is numbered 15 and the mandrel is 16. When the thickening portion of the pipe is rolled out to the required length, the ring roll pair R1, R2 is rotated by the displacement of the toothed rack, without stopping the roll stand but without the shell being fed forward into the mill, until the pass of the stand is characterized by the entry dead center ET2 and the delivery dead center AT2, which is rolling region 2. During the rotation of the ring rolls R1, R2, groove 12 will give a smaller diameter behind the thickened tube end from the position ET1 to AT1 into position ET2 to AT2 without shell advancement. After the shell feed is reengaged, a length of pipe is then rolled out corresponding approximately to the length of groove 12.

In FIG. 4, the cross-section taken along lines B—B of FIG. 2 illustrates the groove and the pipe in the vicinity of the entry dead center ET2. It can be recognized that, after the thickened piece of pipe, the pipe has experienced a considerable reduction of its external diameter. A further gradual rotation of the ring rolls 1, 2 through the movement of the toothed rack to bring the third rolling region designated as ET3 to AT3 into position and without advancing the shell into the mill, the rolling of the actual cross-section of the pipe can now be accomplished. The region from ET3 to AT3 with groove 13, normally for rolling the cross-section of the pipe is used for rolling the remaining length of the final product pipe out up to the beginning of the transition of the rear thickened end. The rear thickened end can now be rolled into position ET1 to AT1 by means of further rotation of roll 1 through an adjustment to the toothed rack, as previously explained.

FIG. 5 shows a cross-section taken along lines C—C of FIG. 2 through the groove and the pipe in the vicinity of the entry dead center ET3 i.e., at the start of the rolling process of the actual pipe. FIG. 6 shows a cross section taken along lines D—D of FIG. 2 showing the groove and the pipe in its finished condition approximately in the range of the smoothing groove. With the process described herein above a working cycle is concluded for the production of one pipe, and the next shell to produce a pipe can be directly put into the mill thereafter.

An essential advantage of the rolling process described is that the rolling process can be carried out without stopping the rolling mill, thereby increasing production and thus it being highly economical to employ the features of the subject invention. Secondly, the process described has been conceived for the rotation and advancement of the shell in the delivery dead center of the rolling areas. As is known, the rotation of the rolls to its various working positions is done by an adjustment of the toothed rack, whereby it would be ideal to use the adjustment of the toothed rack to generate a slight oscillating movement of the toothed rack for each pass or stroke of the roll stand. This movement would be established in such a way that the momentary flow of material and the circumferential speed of the pinion at its pitch line match so that the longitudinal forces on the feed slide and in the mandrel rod are minimized. This procedure is particularly advantageous when the shell is fed wholly or partially into the mill during the delivery dead center portion of the reducing regions, in that, combined with a simple groove design, performance of the machinery is increased and wear and tear to the machinery is lessened since the machinery experiences little overload.

In accordance with the patent statutes, we have explained the principles and operation of our invention and have illustrated and described what we consider to represent the best embodiment thereof.

We claim:

1. A cooperative pair of ring rolls for use in a cold pilger rolling mill for producing a tube having an external extending portion that varies in diameter, for example an enlarged end portion;

said rolls each having at least two different cooperative varying diameter tube producing grooves formed circumferentially around the periphery of said rolls, and wherein said grooves are arranged in a common plane taken perpendicularly through the axis of rotation of said rolls, and further wherein each of said grooves of a given diameter with reference to the processing sequence has after a deforming zone, a smoothing zone and as to at least one of said grooves an additional zone preceding the deforming zone for allowing movement of the tube relative to the roll.

2. A cooperative pair of roll dies according to claim 1, wherein said grooves of each roll has portions that are arranged in a predetermined relationship with reference to a transition portion from one diameter to the other.

3. A cooperative pair of roll dies according to claim 1, wherein said grooves have different widths corresponding to the particular diameters of the portion of the tube produced thereby.

4. A cooperative pair of rolls according to claim 1, wherein each of said grooves has a circumferential point that corresponds with the commencement of the stroke of the mill, and wherein the rolls are positionable so that one or the other of said points can be brought into said corresponding relationship.

5. A cooperative pair of rolls according to claim 1, wherein said grooves of each roll constitute three in number, one groove being formed to produce a transition portion between two different diameter portions.

6. A cooperative pair of rolls according to claim 1, wherein said grooves of each roll constitute three in number, one groove increasing in diameter and the other two decreasing in diameter in the direction of rolling.

7. A method for manufacturing a tube with varying external diameters by reducing a shell formed into a tube over a mandrel in a cold pilger rolling mill, which shell is worked between a set of driven ring rolls each having at least two different cooperative varying diameter tube producing grooves formed circumferentially around the periphery of said rolls, and each groove having a reducing range including a rotating and feeding zone, and a smoothing zone, the steps comprising:

(1) rolling a selected length of said shell in a first said groove to produce a desired first external diameter for said tube, (2) rotating said rolls to bring a said second groove into operation for a continued working of said shell, (3) rolling a selected length of said shell with said second groove to produce a second desired external diameter for said tube different than said first diameter, said rolling in steps (1) and (3) being such as to subject said formed tube to said smoothing zones to effect final processing of said external diameters, and (4) when said tube is in said first and second grooves rotating and selectively feeding said shell in said rotating and feeding zones.

8. A method for manufacturing according to claim 7 wherein said second desired external diameter is smaller than said first diameter

9. A method for manufacturing according to claim 7 wherein said reducing range of said second groove consists of a feeding and rotating zone, a deforming zone and a smoothing zone of said first groove and a second deforming and smoothing zone and for rolling a transitional portion of said tube from said first external diameter to said second external diameter said reducing range of said second groove is brought into engagement during a stroke of the stand, and for said formation of said transitional portion said tube is rotated but not fed into the stand.

10. A method for manufacturing according to claim 7, wherein a third cooperative varying diameter producing groove is formed circumferentially around said periphery of said rolls between said first and second grooves and arranged in a manner that part of its reducing range has a portion overlapping with that of said first groove and a different portion overlapping with that of said second groove, the steps further comprising:

for the forming of said transitional portion, (5) rotating said rolls to bring said third groove into operation, and (6) rolling a selected length of shell after step (1) and before step (3) while at the same time rotating said tube

11. A method of manufacturing according to claim 10, wherein said rolling of step (6) is done by an increasing groove and steps (1) and (3) are done by a decreasing groove.

12. A method according to claims 7 or 11, wherein a said smoothing zone and a said rotating and feeding zone of a given reducing range is used in common with two adjacent grooves.

13. A method according to claim 8, wherein said first desired external diameter is formed at the ends of said tube.

* * * * *